US011885344B1

(12) United States Patent
Peterson et al.

(10) Patent No.: US 11,885,344 B1
(45) Date of Patent: Jan. 30, 2024

(54) ADJUSTABLE MOUNT FOR SECURING FAN ACCESSORY

(71) Applicant: Delta T, LLC, Lexington, KY (US)

(72) Inventors: Gregory Willis Peterson, Nicholasville, KY (US); Vance Elliot Willis, Nunnelly, TN (US); David Matthew Ladnier, Versailles, KY (US); Richard Downey, Daville, KY (US); Edmundo Monti Cortez, Lexington, KY (US); Brian Michael Borgel, Georgetown, KY (US)

(73) Assignee: DELTA T, LLC, Lexington, KY (US)

( * ) Notice: Subject to any disclaimer, the term of this patent is extended or adjusted under 35 U.S.C. 154(b) by 33 days.

(21) Appl. No.: 17/344,307

(22) Filed: Jun. 10, 2021

Related U.S. Application Data

(60) Provisional application No. 63/037,160, filed on Jun. 10, 2020.

(51) Int. Cl.
*F04D 29/00* (2006.01)
*F04D 25/08* (2006.01)

(52) U.S. Cl.
CPC ..... *F04D 29/005* (2013.01); *F04D 25/088* (2013.01)

(58) Field of Classification Search
CPC ..... F04D 25/088; F04D 29/005; F21S 8/043
See application file for complete search history.

(56) References Cited

U.S. PATENT DOCUMENTS

| | | | | |
|---|---|---|---|---|
| 5,097,398 | A * | 3/1992 | Dye | F04D 29/005 362/147 |
| 5,404,284 | A * | 4/1995 | Davis, Jr. | F21V 33/0096 362/147 |
| 10,619,808 | B2 * | 4/2020 | Serak | F21S 8/04 |
| 10,890,191 | B2 * | 1/2021 | Broughman | F16M 13/027 |
| 11,569,624 | B2 * | 1/2023 | Austin | H02G 3/20 |

* cited by examiner

*Primary Examiner* — Courtney D Heinle
*Assistant Examiner* — John S Hunter, Jr.
(74) *Attorney, Agent, or Firm* — Dickinson Wright PLLC; Andrew D. Dorisio

(57) ABSTRACT

A mount is for attaching an accessory to a fan including a downtube. The mount includes a receiver adapted for connecting to the downtube. A retainer is adapted to receive the accessory. The retainer is adapted to support and rotate about the receiver so as to position the accessory in a desired orientation. Related methods of attaching an accessory to a fan are also disclosed.

15 Claims, 2 Drawing Sheets

ADJUSTABLE MOUNT FOR SECURING FAN ACCESSORY

This patent application claims the benefit of U.S. Provisional Patent Application Ser. No. 63/037,160, filed Jun. 10, 2021, the disclosure of which is incorporated herein by reference.

TECHNICAL FIELD

This document relates generally to fans and, more particularly, to an adjustable mount for securing a fan accessory, such as a decorative material or the like, to a fan, such as an overhead or ceiling fan.

BACKGROUND

Ceiling fans often have various accessories that attach to the bottom of the fan, such as decorative covers. These covers are typically mechanically attached to a tube with external threads that extend along the center of the fan.

Readily available mounts sometimes require securing a cover to the ceiling fan in a particular orientation. These mounts are attached to the fan using a standard junction box, which limits the manner in which any cover may be mounted. Thus, available mounts cannot ensure that any cover or accessory is oriented in the direction the customer would like, which is especially troublesome when there is indicia, such as printing or a logo on the cover or accessory.

Accordingly, a need exists for an adjustable mount for fan accessories, such as decorative covers, that allow infinite rotation of the cover after attachment to the fan.

SUMMARY

As shown in the drawing figures, an adjustable mount for mounting an accessory to a fan, such as an overhead or ceiling fan, is provided. The adjustable mount comprises two main components: a receiver and a compatible or complementary retainer adapted to mount or connect to the attachable fan accessory is mounted. The fan accessory may comprise a cover, such as a decorative material that serves to cover the receiver and provide an aesthetically pleasing appearance to the fan. The decorative material or cover may be connected to the receiver separately from the fan, corresponding to a customer's chosen appearance, or may be connected to the fan at the point of manufacture. In either case, the proposed mount provides an easy and inexpensive manner for attaching an accessory to a fan in a desired orientation.

According to a first aspect of the disclosure, a mount for attaching an accessory to a fan including a downtube is provided. The mount includes a receiver adapted to connect to the downtube, such as by way of threading or a fastener. A retainer is adapted to receive the accessory, the retainer further adapted to support and rotate about the receiver so as to position the accessory in a desired orientation.

In one embodiment, the receiver comprises a ring including a peripheral groove. The downtube may include a distal portion, which may be threaded. A fastener, such as in the form of a lock nut, may be provided for engaging the threaded distal portion so as to retain the receiver on the downtube.

The retainer may include a pocket for receiving the retainer. The retainer may further include one or more apertures. A fasteners may also be provided for extending through each of the aperture(s) of the retainer to secure it to the receiver when the accessory is at the desired orientation. Prior to being fixed or secured in place, the retainer may be rotated around or about the receiver, such as for example a full 360 degrees or any portion thereof, to readily achieve the desired orientation.

The accessory may be fixed to the retainer via fasteners. In one example, the accessory comprises a decorative cover. The decorative cover may include indicia, such as a logo, printing, or the like.

According to a further aspect of the disclosure, an apparatus for attaching an accessory is provided. The apparatus comprises a ceiling fan including a downtube. A receiver is provided for receiving the downtube. A retainer is adapted for supporting the accessory, the retainer including an opening for receiving the receiver so as to allow the receiver to rotate around the tube and position the accessory at a desired orientation.

In this or other embodiments, the receiver comprises a ring, which may include a peripheral groove. The downtube may include a distal portion. A fastener may be provided for engaging the threaded distal portion so as to retain the receiver on the downtube.

In one embodiment, the retainer includes a pocket for receiving the retainer. The retainer may further comprise at least two apertures. Fasteners are provided for extending through the apertures of the retainer to secure the retainer to the receiver when the accessory is at the desired orientation. Prior to being fixed in place, the retainer is adapted to rotate around the receiver.

The accessory may be fixed to the retainer via fasteners. In one embodiment, the accessory comprises a decorative cover. The decorative cover may include indicia, such as logos or other printing.

A further aspect of the disclosure pertains to a method for attaching an accessory to a fan including a downtube. The method includes the step of inserting a receiver adapted for supporting the accessory and connected to the downtube into the opening of the retainer. The method further includes rotating the retainer about the receiver to achieve a desired orientation of the accessory. Still further, the method may involve fixing the retainer to the receiver at the desired orientation.

BRIEF DESCRIPTION OF THE DRAWING FIGURES

While the specification concludes with claims which particularly point out and distinctly claim the invention, it is believed the aspects of the disclosure will be better understood from the following description of certain examples taken in conjunction with the accompanying drawings, in which like reference numerals identify the same elements and in which:

DETAILED DESCRIPTION

According to one possible embodiment, the adjustable mount 10 includes a stationary downtube 12 forming a part of the fan, as further described in U.S. Pat. No. 8,876,468, the disclosure of which is incorporated by reference. The tube 12 may be threaded on a distal end 14. For instance, the distal end 14 of the tube 12 may include a particular (e.g., ¾ inch) national pipe thread ("NPT"), although any size or type thread may be used.

Figure 1A:
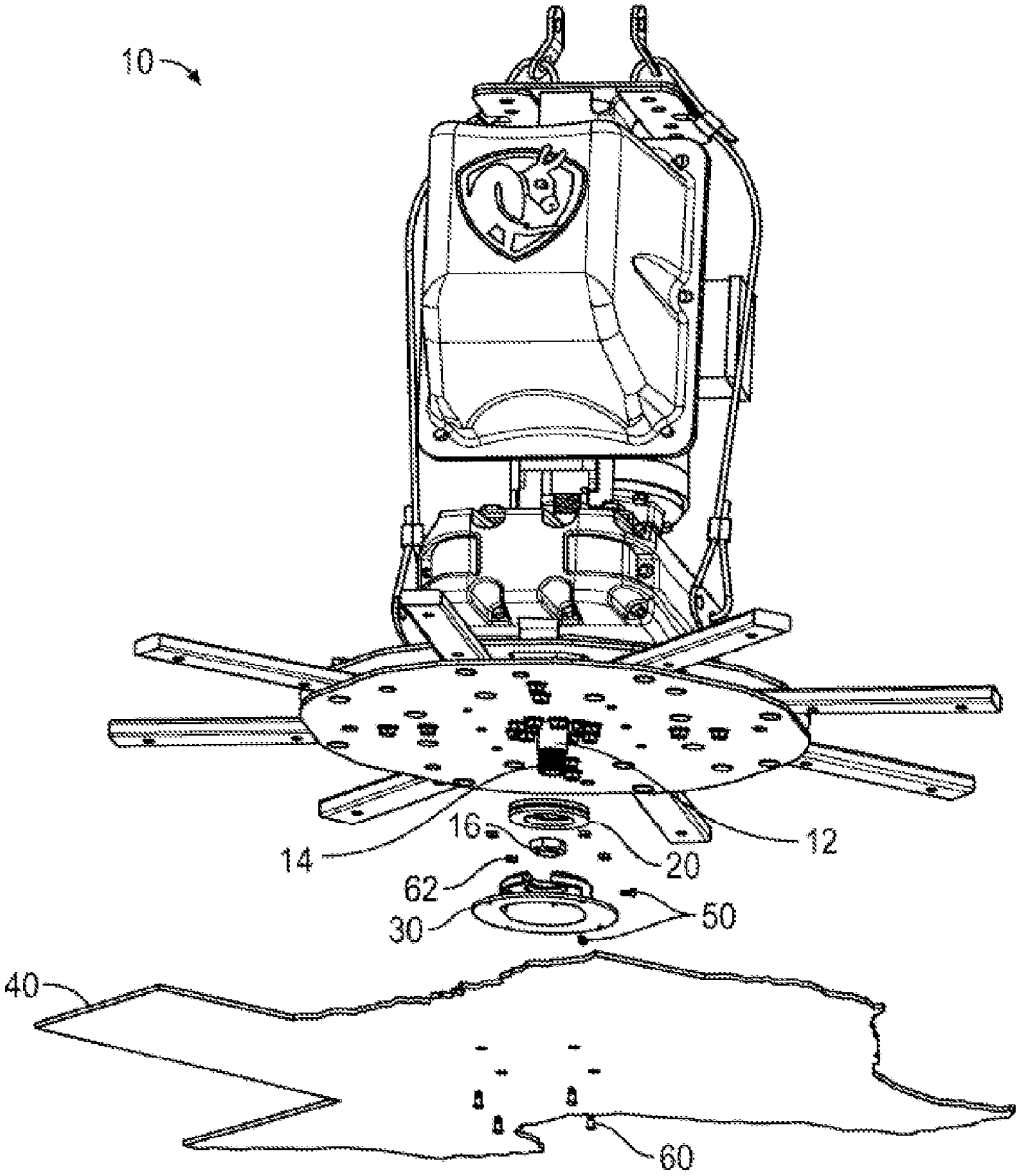
FIG. 1A is a perspective view of an overhead or ceiling fan with an exploded view of the mount according to one aspect of the disclosure.
Figure 1B:
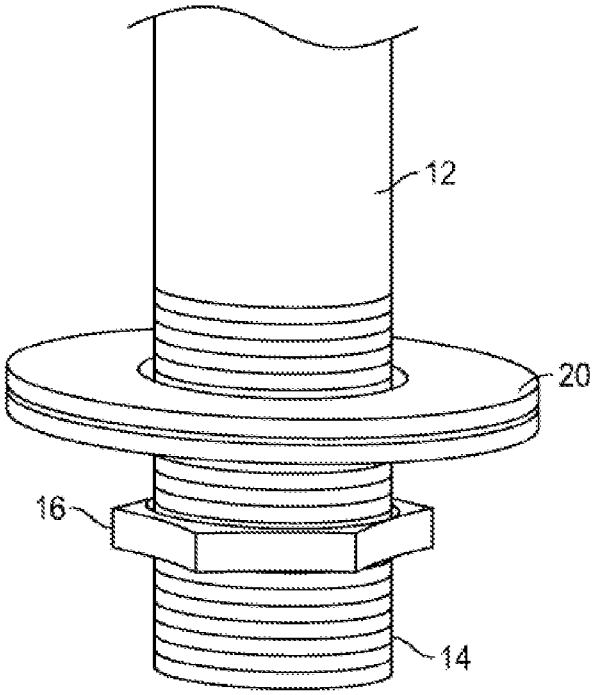
FIG. 1B is a partial perspective view of a downtube of the fan including a receiver and a 20 fastener for fastening the receiver to the downtube.

FIGS. 1A and 1B further illustrate that the mount 10 comprises a receiver 20 and a retainer 30. The 30 receiver 20 may comprise a ring including an opening for receiving the tube 12. A fastener, such as a lock nut 16, may be threaded onto the downtube 12 in order to retain the receiver 20 thereon. Other possible types fasteners, such as a cotter pin or bolt passing into or through a transverse opening in the downtube 12 could also be used alternatively or additionally.

The retainer 30 may also be adapted to receive the receiver 20 and the downtube 12. As more clearly illustrated in FIG. 2, the retainer 30 includes an opening 32 adapted to receive the downtube 12 from a transverse direction (that is, one generally perpendicular to the rotational axis of the fan) and a cavity or pocket 34 sized and shaped to admit the receiver 20, including while connected to the downtube 12. Once inserted into the retainer 30, the receiver 20 is housed in the pocket 34 of the retainer 30 and supported as a result of the cooperation of mating surfaces (the lower inside planer surface of the retainer 30 and the upper outer planar surface of the receiver 20 in the illustrated example).

The retainer 30 may be configured such that the pocket 34 guides the rotation of the retainer 30 about the perimeter of the receiver 20, which again may be connected to the downtube 12 (but not necessarily prior to engaging the retainer 30). In the illustrated embodiment, the retainer 30 is adapted such that it is able to rotate fully (e.g., 360 degrees) around the perimeter of the receiver 20. However, any amount of rotation within this range may be achieved.

Figure 2:
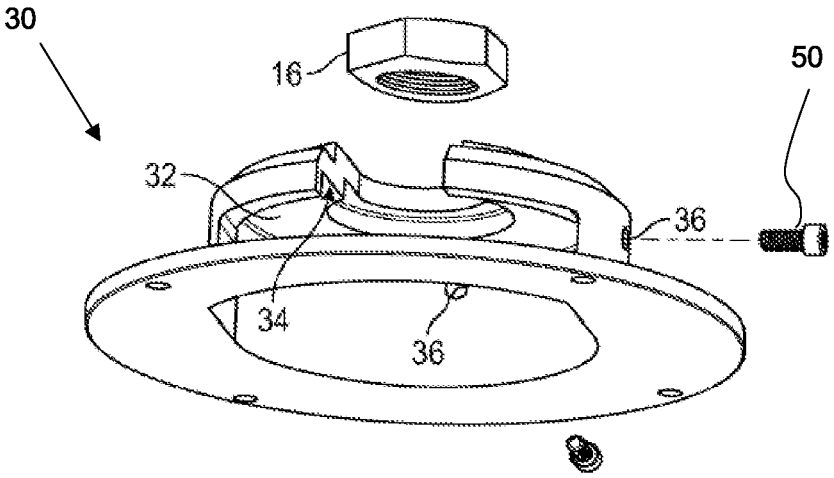
FIG. 2 is a perspective view of a retainer for engaging and supporting the receiver.

FIG. 2 illustrates that the retainer 30 includes one or more apertures 36. In one embodiment, the apertures 36 may be internally threaded. Thus, once the retainer 30 is rotated to its desired position, set screws 50, such as socket head cap screws, may be threaded through the apertures 36 to engage the receiver 20, such as via the peripheral groove. This engagement serves to secure the retainer 30 to the receiver 20 in its desired orientation. These screws 50 when tightened may engage the receiver 20, such that the retainer 30 may not be rotated or lifted off of it, but of course may be loosened to change the orientation or remove the accessory 40 from the fan.

In one embodiment, the accessory 40 may be affixed to the retainer 30 via one or more fasteners, such as bolts 60 and nuts 62. In the illustrated embodiment, the accessory 40 is a decorative plate having non-functional surface indicia (such as here, for example, a representation of the State of Texas), but may take any shape or form.

The accessory 40 may be affixed to the retainer 30 prior to the retainer 30 engaging the receiver 20. In this embodiment, both the accessory 40 and retainer 30 may be rotated about the perimeter of the receiver 20 before the retainer 30 is secured to the receiver 20 using set screws 50. By affixing the accessory 40 to the retainer 30 prior to the retainer 30 engaging the receiver 20, a user may more easily achieve the desired orientation of the accessory 40. In an alternate embodiment, a user may insert the receiver 20 into the retainer 30 prior to affixing the accessory 40 to the retainer 30.

In another aspect of the disclosure, a method for mounting an accessary on a fan is provided. The method may involve threading a receiver 20 onto a tube 12 of a fan. The method may involve placing the receiver 20 onto the distal end 14 of the tube 12 and securing in place using a fastener. The method may further involve affixing the accessory 40, such as decorative a cover, to the retainer 30, which may further include the opening 32, pocket 34, and apertures 36.

The method may further involve inserting the receiver 20 into the opening 32 of the retainer 30, such that the receiver 20 is located in the pocket 34. Rotating the retainer 30 and accessory 40 about the perimeter of the receiver 20 may be done to achieve the desired orientation of the assembly 40. Fixing the retainer 30 and assembly 40 into the desired orientation on the receiver 20 may be achieved using fasteners, such as set screws 50 passing through apertures 36 so as to receiver 20 (and in particular a peripheral groove thereof).

Each of the following terms written in singular grammatical form: "a", "an", and the", as used herein, means "at least one", or "one or more". Use of the phrase One or more" herein does not alter this intended meaning of "a", "an", or "the". Accordingly, the terms "a", "an", and "the", as used herein, may also refer to, and encompass, a plurality of the stated entity or object, unless otherwise specifically defined or stated herein, or, unless the context clearly dictates otherwise. For example, the phrases: "a unit", "a device", "an assembly", "a mechanism", "a component, "an element", and "a step or procedure", as used herein, may also refer to, and encompass, a plurality of units, a plurality of devices, a plurality of assemblies, a plurality of mechanisms, a plurality of components, a plurality of elements, and, a plurality of steps or procedures, respectively.

Each of the following terms: "includes", "including", "has", "having", "comprises", and "comprising", and, their linguistic/grammatical variants, derivatives, or/and conjugates, as used herein, means "including, but not limited to", and is to be taken as specifying the stated components), feature(s), characteristic(s), parameter(s), integer(s), or step(s), and does not preclude addition of one or more additional components), feature(s), characteristic(s), parameter(s), integer(s), step(s), or groups thereof. Each of these terms is considered equivalent in meaning to the phrase "consisting essentially of. Each of the phrases "consisting of and "consists of," as used herein, means "including and limited to."

The phrase "consisting essentially of," as used herein, means that the stated entity or item (system, system unit, system sub-unit device, assembly, sub-assembly, mechanism, structure, component element or, peripheral equipment utility, accessory, or material, method or process, step or procedure, sub-step or sub-procedure), which is an entirety or part of an exemplary embodiment of the disclosed invention, or/and which is used for implementing an exemplary embodiment of the disclosed invention, may include at least one additional feature or characteristic being a system unit system sub-unit device, assembly, sub-assembly, mechanism, structure, component or element or, peripheral equipment utility, accessory, or material, step or procedure, sub-step or sub-procedure, but only if each such additional feature or characteristic does not materially alter the basic novel and inventive characteristics or special technical features, of the claimed item.

The term "method," as used herein, refers to steps, procedures, manners, means, or/and techniques, for accomplishing a given task including, but not limited to, those steps, procedures, manners, means, or/and techniques, either known to, or readily developed from known steps, procedures, manners, means, or/and techniques, by practitioners in the relevant field(s) of the disclosed invention.

Terms of approximation, such as the terms about, substantially, approximately, etc., as used herein, refers to ±10% of the stated numerical value. "Generally polygonal" means that the shape has flat surfaces, as with a polygon, but may have rounded corners connecting these surfaces.

The phrase "operatively connected," as used herein, equivalently refers to the corresponding synonymous phrases "operatively joined", and "operatively attached," where the operative connection, operative joint or operative attachment, is according to a physical, or/and electrical, or/and electronic, or/and mechanical, or/and electro-mechanical, manner or nature, involving various types and kinds of hardware or/and software equipment and components.

It is to be fully understood that certain aspects, characteristics, and features, of the invention, which are, for clarity, illustratively described and presented in the context or format of a plurality of separate embodiments, may also be illustratively described and presented in any suitable combination or sub-combination in the context or format of a single embodiment. Conversely, various aspects, characteristics, and features, of the invention which are illustratively described and presented in combination or sub-combination in the context or format of a single embodiment may also be illustratively described and presented in the context or format of a plurality of separate embodiments.

The invention claimed is:

1. A mount for attaching an accessory to a fan including a downtube, comprising:

a receiver adapted to connect to the downtube; and a retainer adapted to receive the accessory, the retainer including an opening adapted to receive the downtube from a transverse direction and a cavity adapted to receive the receiver therein while connected to the downtube so as to form a non-threaded, slidable engagement between the retainer and the receiver and to support and rotate about the receiver so as to position the accessory in a desired orientation;

wherein the cavity includes a recessed seat therein for retaining the receiver in place within the cavity.

2. The mount of claim 1, wherein the receiver comprises a ring including a peripheral groove.

3. The mount of claim 1, wherein the downtube includes a distal portion projecting below the fan, and further including a fastener for engaging the distal portion so as to retain the receiver on the downtube.

4. The mount of claim 1, wherein the accessory is fixed to the retainer via fasteners.

5. The mount of claim 1, wherein the accessory comprises a decorative cover.

6. The mount of claim 1, wherein the retainer is adapted to rotate around the receiver.

7. The mount of claim 1, wherein the retainer is adapted to rotate 360 degrees around the receiver.

8. The mount of claim 1, further including a fastener adapted for engaging the receiver and the downtube within the cavity of the retainer for retaining the receiver on the downtube.

9. An apparatus for attaching an accessory, comprising:

a ceiling fan including a downtube;

a receiver for receiving the downtube; and a retainer adapted for supporting the accessory, the retainer including a lateral opening adapted to receive the downtube from a transverse direction, and a cavity adapted to receive the receiver therein, the cavity including a recess in an upper portion of the retainer for providing a seat for the receiver;

such that the retainer forms a non-threaded, slidable engagement with the receiver so as to allow the receiver to rotate around the tube and position the accessory at a desired orientation.

10. The mount of claim 9, wherein the receiver comprises a ring.

11. The mount of claim 9, wherein the downtube includes a distal portion, and further including a fastener for engaging the distal portion and the receiver within the cavity of the retainer so as to retain the receiver on the downtube.

12. The mount of claim 9, wherein the retainer further comprises at least one aperture, and further including at least one fastener for extending through the at least one aperture of the retainer to secure the retainer to the receiver when the accessory is at the desired orientation.

13. The mount of claim 9, wherein the accessory is fixed to the retainer via fasteners.

14. The mount of claim 9, wherein the accessory comprises a decorative cover.

15. The mount of claim 9, wherein the retainer is adapted to rotate around the receiver.

* * * * *